United States Patent [19]

Morgan et al.

[11] 4,278,840

[45] Jul. 14, 1981

[54] DYNAMIC FREQUENCY AND TIME VOICE ENCRYPTION SYSTEM AND METHOD

[75] Inventors: Barrie O. Morgan; Mitchell M. Wilkinson, both of Dallas, Tex.

[73] Assignee: Datotek, Inc., Dallas, Tex.

[21] Appl. No.: 23,170

[22] Filed: Mar. 23, 1979

[51] Int. Cl.[3] ..... H04K 1/04

[52] U.S. Cl. ..... 179/1.5 S; 179/1.5 R

[58] Field of Search ..... 179/1.5 R, 1.5 S, 1.5 E

[56] References Cited

U.S. PATENT DOCUMENTS

| | | | |
|---|---|---|---|
| 1,709,901 | 4/1929 | Espenschied et al. . | |
| 1,757,181 | 5/1930 | Espenschied . | |
| 1,829,783 | 11/1931 | Chestnut et al. . | |
| 2,132,205 | 10/1938 | Dickieson . | |
| 2,407,260 | 9/1946 | Dickieson | 179/1.5 R |
| 2,411,683 | 11/1946 | Guanella | 179/1.5 R |
| 2,586,475 | 2/1952 | Milliquet | 179/1.5 R |
| 3,624,297 | 11/1971 | Chapman | 179/1.5 S |
| 3,723,878 | 3/1973 | Miller | 179/1.5 S |
| 3,773,977 | 11/1973 | Guanella | 179/1.5 R |
| 3,824,467 | 7/1974 | French | 179/1.5 S |
| 3,886,313 | 5/1975 | Branscome et al. | 179/1.5 S |
| 3,909,534 | 9/1975 | Majeau et al. | 179/1.5 R |
| 3,921,151 | 11/1975 | Guanella | 179/1.5 S |
| 4,020,285 | 4/1977 | Branscome et al. | 179/1.5 R |
| 4,068,094 | 1/1978 | Schmid et al. | 179/1.5 R |
| 4,100,374 | 11/1978 | Jayant et al. | 179/1.5 R |
| 4,115,657 | 9/1978 | Morgan | 179/1.5 R |
| 4,133,977 | 1/1979 | McGuire | 179/1.5 R |
| 4,149,035 | 4/1979 | Frutiger | 179/1.5 R |
| 4,159,399 | 6/1979 | Asakawa et al. | 179/1.5 R |
| 4,182,933 | 1/1980 | Rosenblum | 179/1.5 R |

OTHER PUBLICATIONS

"Final Report on Project C-66, Frequency-Time Division Speech Privacy System", Prepared for Division 13, Section 3 of the National Defense Research Committee of the Office of Scientific R & D by Bell Telephone Laboratories, Inc., dated May 29, 1943 (Contract No. OEMsr-795).

*Primary Examiner*—Howard A. Birmiel

*Attorney, Agent, or Firm*—Richards, Harris & Medlock

[57] ABSTRACT

A voice scrambler system (10) for encryption of a voice signal is provided. The voice scrambler system (10) includes a first generator (124) for generating a fixed frequency signal. A second generator (132) is provided for generating a plurality of frequency signals. Control circuitry (134) is provided for dynamically controlling the second generator (132) for randomly generating the plurality of variable frequency signals. A mixer (122) heterodynes the voice signal with the fixed frequency signal generated by the first generator (124). A filter (126) filters the output of the first mixer (122). An adder (128) adds the voice signal and the output of the first filter (126). A second mixer (130) heterodynes the output of the adder (128) with one of the plurality of frequency signals generated by the second generator (132). A second filter (136) filters the output of the second mixer (130) to generate an encrypted voice signal.

29 Claims, 7 Drawing Figures

DYNAMIC FREQUENCY AND TIME VOICE ENCRYPTION SYSTEM AND METHOD

TECHNICAL FIELD

This invention relates to the secure transmission of audio signals, and more particularly relates to a system and method utilizing frequency re-entrant and time division signal processing.

BACKGROUND ART

It is important in many areas of government and business to insure that voice messages be transmitted to a remote location with a high degree of privacy. Thus, systems have previously been developed for message scrambling or encryption wherein a voice signal is divided into a plurality of sub-bands and the order of the sub-bands is then randomly varied in conjunction with random inversion of ones of the sub-bands. The reordered and inverted sub-bands are then transmitted over a communications link in an unintelligible state. Additionally, previously developed systems have divided a voice signal into a plurality of discrete time-frequency segments. The order of these segments are then randomly rearranged in order to render the voice signal unintelligible. Only a remote receiving station having a properly coded unit is able to properly reorder the frequency bands in time and space in order to render the voice signal intelligible.

Examples of such previously developed voice scrambling systems may be found in U.S. Pat. No. 1,709,901 issued to Espenschied et al on Apr. 23, 1929 and entitled "Secret Signaling System"; U.S. Pat. No. 2,411,683 issued to Guanella on Nov. 26, 1946 and entitled "Method and Arrangement for Scrambling Speech Signals"; and U.S. Pat. No. 4,020,285 issued to Branscome et al on Apr. 26, 1977 and entitled "Voice Security Method and System". Additionally, examples of such previously developed and proposed voice scrambling systems are described in a publication entitled "Final Report on Project C-66, Frequency Time Division Speech Privacy System" prepared for Division 13, Section 3 of the National Defense Research Committee of the Office of Scientific Research and Development by Bell Telephone Laboratories, Inc., dated May 29, 1943 (Contact No. OEMsr-795).

However, many previously developed voice scrambling systems have not been sufficiently secure for users of such systems. The level of security has also depended upon the complexity of the scrambling or encryption system, and it has been thought that a more complex and costly built system insured a more secure system. Therefore, a need has developed for a relatively simple encryption system which provides a high level of security. A need has also arisen for a two-dimensional scrambling system where both frequency and time dimensions are utilized in the encryption process. A need has further arisen for an encryption system in which a plurality of remote stations utilize a single encryption unit where multiple users desire to transmit secure messages.

DISCLOSURE OF THE INVENTION

In accordance with the present invention, a dynamic frequency and time voice encryption system and method is provided which substantially eliminates or reduces the problems heretofore present in voice encryption systems.

In accordance with the present invention, a voice scrambler system for encryption of a voice signal includes a first generator for generating a fixed frequency signal. A second generator is provided for generating a plurality of frequency signals. A control circuit dynamically controls the second generator for randomly generating the plurality of frequency signals. A mixer heterodynes the voice signal with the fixed frequency signal generated by the first generator. A filter is provided for filtering the output of the first mixer. An adder adds the voice signal and the output of the first filter. A second mixer heterodynes the output of the adder with one of the plurality of frequency signals generated by the second generator. A second filter filters the output of the second mixer to generate an encrypted voice signal.

In accordance with another aspect of the present invention, a voice scrambler system for encryption of a voice signal includes a tapped analog delay line. The tapped analog delay line includes a plurality of bucket brigade devices for splitting the voice signal into a plurality of discrete time-frequency segments. Circuitry is provided for periodically sampling the outputs of the plurality of bucket brigade devices in a random order for generating an encrypted voice signal.

In accordance with another aspect of the present invention, a voice scrambler system for encryption of a voice signal includes a first generator for generating a fixed frequency signal. A second generator is provided for generating a plurality of frequency signals at a predetermined rate. A third generator is provided for generating a fixed frequency signal. A control circuit is provided for dynamically controlling the second generator for randomly generating the plurality of frequency signals. A first filter band limits the voice signal and generates a filtered voice signal. A first mixer heterodynes the filtered voice signal with the fixed frequency signal generated by the first generator. A second filter filters out the low side-band output from the first mixer. The voice scrambler system further includes an adder for adding the filtered voice signal and the output of the second filter. A second mixer is also provided for heterodyning the output of the adder with one of the plurality of frequency signals generated by the second generator. A third filter filters the output of the second mixer and generates an encrypted voice signal. A third mixer heterodynes the encrypted voice signal with the fixed frequency generated by the third generator. A fourth filter filters the output of the third mixer for generating an encrypted voice signal within a predetermined pass band for transmission over a communications link. The voice scrambling system further includes a tapped analog delay line including a plurality of bucket brigade devices for receiving the encrypted voice signal from the fourth filter and for splitting the encrypted voice signal into a plurality of discrete time-frequency segments. Circuitry is provided for randomly selecting at a predetermined rate one of the plurality of time-frequency segments to thereby rearrange the order of the plurality of time-frequency segments and provide a second level or dimension of voice encryption of the voice signal.

In accordance with another aspect of the present invention, a remote voice security system for encryption of voice signals is provided. The remote voice security system includes a voice scrambler. A generator is located at a plurality of stations for generating control signals. A receiver is interconnected to the voice scrambler for receiving the control signals generated at the plurality of remote stations, such that a plurality of users can utilize the voice scrambler for encryption of voice signals transmitted from the plurality of stations.

In accordance with another aspect of the present invention, a method of voice scrambling for encryption of voice signals is provided. The method includes generating a fixed frequency signal and a plurality of variable frequency signals. The generation of the plurality of variable frequency signals is dynamically controlled to randomly generating these frequency signals. The voice signal is heterodyned with the fixed frequency signal and is filtered. The filtered signal is added to the voice signal to generate a summation signal. The summation signal is heterodyned with one of the plurality of variable frequency signals. This heterodyned frequency is then filtered to generate an encrypted voice signal.

BRIEF DESCRIPTION OF DRAWINGS

For a more complete understanding of the present invention and for further objects and advantages thereof, reference is now made to the following Detailed Description taken in conjunction with the accompanying Drawings in which.

DETAILED DESCRIPTION

Figure 1:
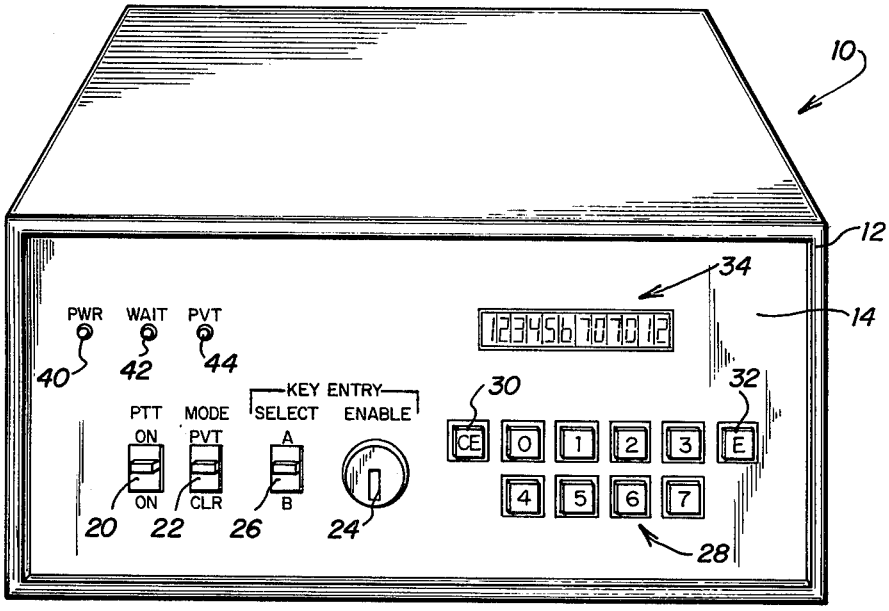
FIG. 1 is a perspective view of the voice scrambler system of the present invention.

Referring to FIG. 1, a perspective view of the voice scrambler system constructed in accordance with the present invention is illustrated and is generally identified by the numeral 10. Voice scrambler system 10 is packaged in a metal casing 12 and includes a front panel 14. At the rear of metal casing 12 (not shown) are a power on/off switch to provide power to voice scrambler system 10, an input connector to permit signals to be input from a microphone, handset or the like to voice scrambler system 10 and an output connector for application of output signals to a telephone or radio communications link or the like.

Front panel 14 of voice scrambler system 10 includes a Push-To-Talk switch 20 for operation when it is desired to transmit voice information through voice scrambler system 10. Push-To-Talk switch 20 may comprise a rocker switch such that when the lower edge of Push-To-Talk switch is pressed, Push-To-Talk switch 20 acts as a momentary, spring return switch. When pressed towards the top of metal casing 12, Push-To-Talk switch 20 acts as a continuously on toggle switch. When it is desired to receive information, Push-To-Talk switch 20 is not depressed, but is positioned in the center or off position, as illustrated in FIG. 1.

A mode switch 22 is also provided for voice scrambler system 10. Mode switch 22 may be placed in either the Private transmission position (PVT) or the Clear position (CLR). Mode switch 22 may comprise a spring-loaded switch that automatically returns to the center position, illustrated in FIG. 1. The mode of operation for voice scrambler system 10 is established by momentarily pressing mode switch 22 to the desired clear or private position. The setting of mode switch 22 sets a toggle circuit which holds scrambler system 10 in the desired mode until mode switch 22 is momentarily held in the opposite position. In the Clear mode, the encoding circuits within voice scrambler system 10 are bypassed both on the transmit and receive modes of operation. The voice transmission is therefore the same as the input voice signal. In the Private mode, the transmitted voice signal is encoded by voice scrambler system 10 and the received signal is decoded after receiving the proper synchronization signals at the receiving station.

Front panel 14 of voice scrambler system 10 further includes a key entry enable lock operable to prevent unauthorized entry of key codes into voice scrambler system 10. A key entry select A/B switch 26 is provided to enable either key code segment A or B to be entered into voice scrambler system 10. Eight push button switches numbered 0 through 7, generally identified by the numeral 28, comprise the key variable entry keyboard to provide entry of octal key codes to voice scrambler system 10. A clear entry push button (CE) 30 clears the key code entered into voice scrambler system 10 and allows for correction of incorrect entries. An entry push button (E) 32 is utilized to enter key codes consisting of 12 digits.

The codes entered are displayed on a display generally identified by the numeral 34. Display 34 is a 12 digit display for displaying the key code as it is entered into voice scrambling system 10. The key code fills display 34 from left to right as the code is entered via key variable entry keyboard 11. Depression of the clear entry push button 30 clears display 34 while depression of the entry push button 32 enters the key code displayed on the display 34 into voice scrambler system 10.

Front panel 14 of voice scrambler system 10 further includes a power indicator 40. Power indicator 40 is illuminated to indicate that power is being applied to voice scrambler system 10. A wait indicator 42 is illuminated briefly when the mode of operation is switched to Private or after the Push-To-Talk switch 20 is actuated. Voice communication through voice scrambler system 10 is suspended while wait indicator 42 is illuminated. A private (PVT) indicator 44 is illuminated continuously when voice scrambler system 10 is in the Private mode of operation and repeatedly blinks to alert the operator that the transmitted voice signal is not being scrambled or encoded when voice scrambler system 10 is operated in the Clear mode of operation.

Voice scrambler system 10 provides a possibility of $4.72\times10^{21}$ key codes by using two 12-digit octal key code segments entered through key entry select A/B switch 26. Key variable entry keyboard 28 permits entry of a 12-digit key code into each of key code storage memories A and B of voice scrambler system 10 to provide 24 key variables. Briefly, the procedure, in order to set the key code for voice scrambler system 10, involves inserting the proper key into key entry enable lock 24 and rotating the key fully clockwise. The key entry select A/B switch 26 is positioned to the A position. A 12-digit A segment key code is entered by depressing the push buttons of the key variable entry keyboard 28. The entered numbers will be displayed as they are entered on display 34. The first number entered will be displayed in the extreme left of display 34. The second number entered will be in the second display position from the left, and the numbers as they are entered will continue to enter from left to right until twelve digits are entered. If any entry error is made, the clear entry push button switch 30 can be depressed and the key code entry can again be repeated.

An entry into the memory of voice scrambler system 10 cannot be completed until 12 digits are indicated on display 34. When the key code is displayed properly, the entry push button switch 32 is depressed to enter the displayed key into the key code memory of voice scrambler system 10. The displayed numbers in display 34 will be removed immediately upon depressing the entry push button switch 32.

The key entry select A/B switch 26 is then positioned to the B position to enter the second half of the selected key code consisting of another 12 digits. After these 12 digits have been displayed on display 34, the enter push button switch 32 is depressed to enter this key code into the key code memory of voice scrambler system 10. Once the 24-digit key code is entered, the key entry enable lock 24 is turned counterclockwise to lock the key entry of voice scrambler system 10. Even though the total key code consists of both the A and B segments, the key code in the A segment storage can be changed without affecting the key code in the B segment storage. Similarly, the key code in the B segment storage can be changed without affecting the key code in the A segment storage.

Figure 2:
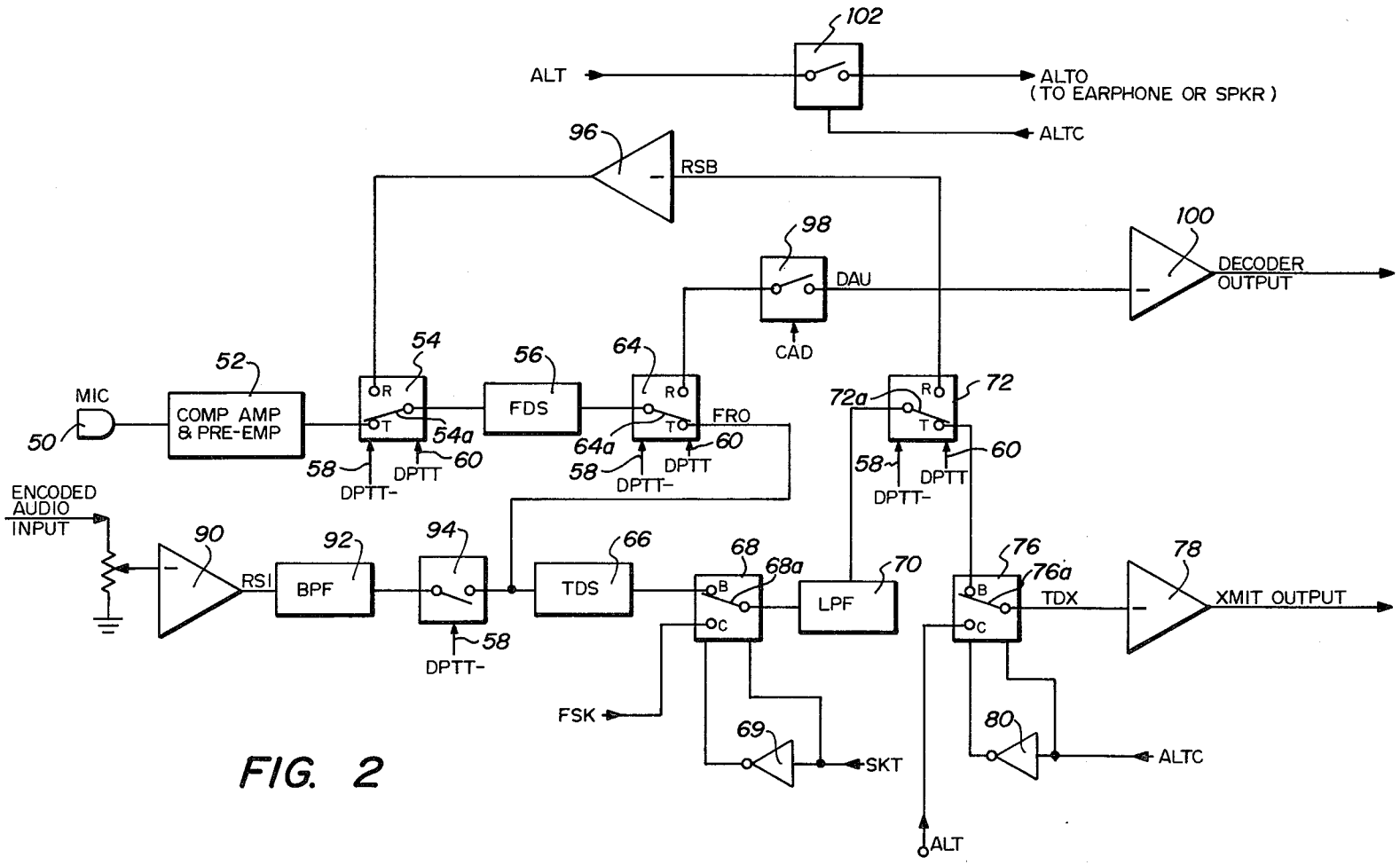
FIG. 2 is a block diagram of the present voice scrambler system.

FIG. 2 is a block diagram of the present voice scrambling system 10. A microphone 50 is adapted to receive voice signals. The audio output of microphone 50 is applied to a compression amplifier and pre-emphasis network 52 and is routed through an electronic switch 54 to a frequency division section (FDS) 56. The frequency division section 56 of voice scrambler system 10 will be subsequently described with reference to FIG. 3. Electronic switch 54 includes a switch arm 54*a* movable between the R and T terminals. As shown in FIG. 2, when switch arm 54*a* contacts the T terminal, voice scrambler system 10 is in the transmit mode. When switch arm 54*a* contacts the R terminal, voice scrambler system 10 is in the receive mode. The positioning of switch arm 54*a* is controlled by operation of Push-To-Talk switch 20 (FIG. 1) which generates the Push-To-Talk signal represented by two signal lines, DPTT- and DPTT applied to electronic switch 54 by signal lines 58 and 60. Electronic switch 54 is a solid state, single-pole, double-throw switch.

The output of frequency division section 56 is applied to an electronic switch 64 having a switch arm 64*a*. Switch arm 64*a* is movable between the transmit position as illustrated in FIG. 1 by contacting the T terminal and a receive position by contacting the R terminal. Switch arm 64*a* is controlled by the Push-To-Talk signal applied by signal lines 58 and 60 to electronic switch 64. The output of electronic switch 64 routes the frequency encoded audio (FRO) from frequency division section (FDS) 56 to time division segmenting section (TDS) 66 of voice scrambler system 10. Time division segmenting section 66 will be subsequently described with reference to FIG. 5.

The output of time division segmenting section 66 is applied to an electronic switch 68. Electronic switch 68 is closed by contacting terminal B at all times except at the beginning of each transmission. At the beginning of each transmission, switch arm 68*a* is moved to terminal C to enable transmission of the correlation pattern and prime signal which appear as a frequency shift keyed (FSK) signal generated by voice scrambler system 10. The SKT signal is applied through an inverter 69 to electronic switch 68 to gate the FSK signal to a low pass filter 70. During the transmit operations of voice scrambler system 10, the frequency and time encoded voice signal and the frequency shift keyed data are filtered through low pass filter 70. In the preferred embodiment, the cut-off frequency of low pass filter 70 is set so that it provides no attenuation inside the 350–2500 Hertz frequency band. Low pass filter 70 also includes an active low pass filter which, in the preferred embodiment, adds a cut-off frequency of approximately 2500 Hertz to provide a smoothing of the voice time segments and provides further attenuation of the time division segmenting section clocking frequency.

The output of low pass filter 70 is applied to an electronic switch 72 having a switch arm 72*a* which is activated by the Push-To-Talk signals DPTT- and DPTT applied via signal lines 58 and 60. During the transmit mode as illustrated in FIG. 2, the audio signal is routed to the B terminal of an electronic switch 76 having a switch arm 76*a*. The audio signal (TDX) from electronic switch 78 passes to a interface amplifier 78 to generate the transmit output signal. Switch arm 76*a* of electronic switch 76 is movable between the B terminal position in the normal transmit mode and the C terminal position. Should the key generator of voice scrambler system 10 fail during operation in the transmit mode, switch arm 76*a* moves to the C terminal to open electronnic switch 76 and apply the alarm tone signal (ALT) to electronic switch 76 under the control of the alarm tone control signal (ALTC) applied through an inverter 80 to electronic switch 76. When the key generator fails, a steady tone is passed through amplifier 78 to alert both the operator talking and the operator at the receiving end of voice scrambler system 10 that the key generator at the transmitter has failed. The output signal generated through amplifier 78 is coupled to an appropriate interface for telephone or radio transmission.

FIG. 2 also illustrates the operation of voice scrambler system 10 in the receive mode of operation. Referring again to FIG. 2, the encoded received audio is applied through an amplifier 90 to generate the received encoded audio input signal (RSI). The received encoded audio input signal is applied to a bandpass filter 92 which includes a low pass filter having a cut-off frequency in the preferred embodiment of 2500 Hertz and a high pass filter which has a cut-off frequency in the preferred embodiment of 350 Hertz. Bandpass filter 92 eliminates any noise appearing outside the desired frequency passband. The output of bandpass filter 92 is applied through an electronic switch 94 under the control of the Push-To-Talk signal DPTT- applied via signal line 58 to time division segmenting section 66. Time division segmenting section rearranges the audio in time to match the original transmitted audio signal through voice scrambler system 10.

The output of time division segmenting section 66 is applied through electronic switch 68 to low pass filter 70 and is routed through electronic switch 72 in which switch arm 72*a* contacts the R terminal. The output of electronic switch 72 is the RSB signal representing encoded audio in which the TDS portion is only decoded. The RSB signal is applied to a level compensating amplifier 96. The output of level compensating amplifier 96 is applied through electronic switch 54 in which switch arm 54*a* contacts the R terminal to apply the output of level compensating amplifier 96 to frequency division section 56. Frequency division section 56 rearranges the frequencies to recover the original audio, which is applied through electronic switch 64 in which switch arm 64*a* contacts the R terminal. The output of electronic switch 64 is applied to an electronic switch 98 which under the control of the CAD audio gate control signal generates the decoded audio output signal (DAU). The DAU signal is routed to a decoder audio output amplifier 100 to generate the decoded output signal.

As previously indicated, the operations of voice scrambler system 10 are synchronized at the beginning of each transmission by the FSK data. These data pulses contain information necessary to cause correct permutations to be applied. The time relationship of the pulses of FSK data cause the clock in the receiving portion of voice scrambler system 10 to adjust itself to be in phase with the transmitter clock so that permutations will be applied at the proper time.

The key generator of voice scrambler system 10 controls the selection and application of the permutations used in encoding and decoding. If the key generator fails, the audio output path is open-circuited by electronic switch 76 and the warning tone signal, ALT, is substituted. This tone is also applied to an electronic switch 102 together with the ALTC control signal to generate the alarm tone output signal ALTO, applied to an earphone or speaker to alert the user of voice scrambler system 10 of a key generator failure.

Figure 3:
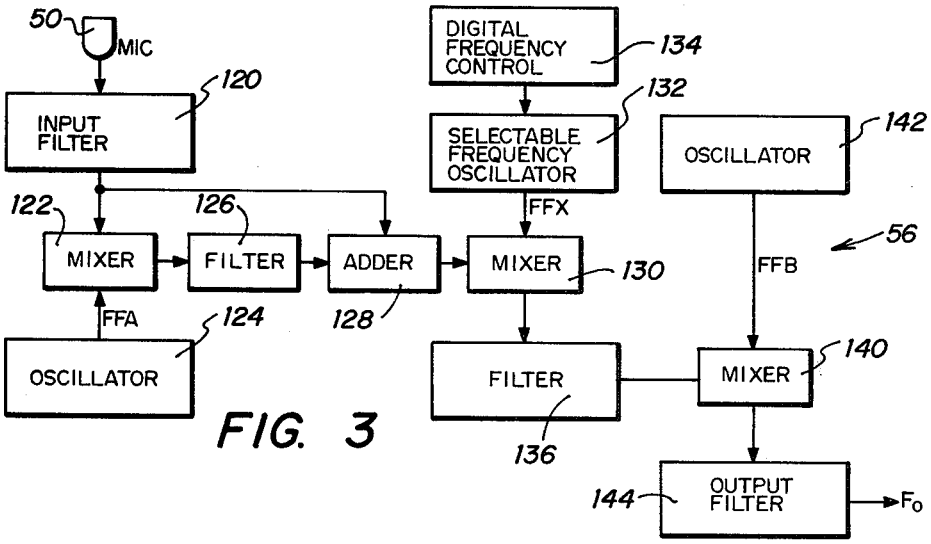
FIG. 3 is a detail block diagram of the frequency division section shown in the block diagram of FIG. 2 of the present voice scrambler system.

Referring to FIG. 3, a block diagram of the frequency division section 56 (FIG. 2) of voice scrambler system 10 is illustrated. The voice signal from microphone 50 is applied to an input filter 120. The purpose of input filter 120 is to attenuate in the preferred embodiment all frequencies below 350 Hertz and above 2500 Hertz and pass those frequencies within the 350 Hertz to 2500 Hertz frequency band. The signal output from input filter 120 in the transmit mode of operation of voice scrambler system 10 consists of band-limited audio and during the receive mode of operation consists of frequency-encoded audio. The output of input filter 120 is routed to a mixer circuit 122. Mixer circuit 122 combines the incoming audio signal from input filter 120 with a fixed frequency (FFA) of 2300 Hertz in the preferred embodiment generated by an oscillator 124 to form sum and difference frequencies at its output. Mixer circuit 122 operates to heterodyne the output of input filter 120 with the FFA signal generated by oscillator 124.

The output of mixer circuit 122 is supplied to a filter 126 which, in the preferred embodiment, functions as an upper side-band filter to pass only the sum frequency of mixer circuit 122 and attenuate the difference frequency. In the preferred embodiment, filter 126 has a passband from 2650 Hertz to 4800 Hertz. The output of filter 126 is applied to an adder 128 which also receives the direct voice signal from the output of input filter 120. The output of adder 128 consists of both direct audio and the upper side-band audio from filter 126. These combined signals are applied to a mixer circuit 130.

The local oscillator signal for mixer circuit 130 is furnished by a selectable frequency oscillator 132 in the form of the FFX signal. Control for selectable frequency oscillator 132 is provided by a digital frequency control 134 which selects one of 16 different discrete local oscillator frequencies generated by selectable frequency oscillator 132 in the preferred embodiment of the present invention. Digital frequency control 134 selects one of the 16 fixed frequencies at a predetermined rate. In the preferred embodiment, this predetermined rate can be either 7.5 or 15 frequencies per second. Additionally, digital frequency control 134 can select a constant frequency of one of the 16 fixed frequencies to be applied to mixer circuit 130. Because mixer circuit 130 heterodynes the output of adder 128 with the FFX signal from selectable frequency oscillator 132, two pair of sum and difference frequencies are generated at the output of mixer 130. The sum and difference frequencies enter a filter 136. In the preferred embodiment, filter 136 passes all frequencies in the range of 2400 Hertz to 4550 Hertz. The output of filter 136 is applied to a mixer circuit 140.

Mixer circuit 140 is driven by an oscillator 142 which generates the FFB signal. In the preferred embodiment, oscillator 142 is fixed at a frequency of 4900 Hertz. The purpose of mixer circuit 140 is to translate the frequencies passed by filter 136 down to the voice band frequency range which can then be transmitted over a radio or telephone communications link. The output of mixer circuit 140 being a heterodyned signal includes both sum and difference frequencies. However, only the difference frequency of the output of mixer circuit 140 is desired since these frequencies fall within the 350 Hertz to 2500 Hertz voice band. The output of mixer 140 is applied to an output filter 144 to pass all frequencies between 350 Hertz and 2500 Hertz. The output of output filter 144 represents the encoded replica of the original voice signal applied to the input filter 120 and is identified by the signal $F_0$.

The frequency division section 56 (FIG. 2) illustrated in FIG. 3 comprises a frequency re-entrant system in which speech frequencies are shifted within a predetermined passband. The energy of a portion of the passband is shifted out one side of the passband and enters from the other side of the passband to thereby maintain the complete energy content of the passband. The encoded voice signal from a frequency re-entrant system is restored to its original form by processing the voice signal through the same circuitry as illustrated in FIG. 3. For each different FFX signal generated by selectable frequency oscillator 132 used in encoding the original voice, there is a corresponding FFX (DEC) signal which will translate the encoded voice spectrum back to its original form. Table 1 provides a list of 16 frequencies (FFX) utilized in the preferred embodiment of voice scrambler system 10. Table 1 also illustrates the operation of frequency division section 56 (FIG. 2) using three illustrative voice frequencies. The three voice frequencies shown in Table 1 are $F_1$, $F_2$ and $F_3$ corresponding to 350 Hertz, 1050 Hertz and 2450 Hertz. As noted in the first row of Table 1, if FFX is 5300 Hertz, the translated frequency for $F_1$ is 2250 Hertz, $F_{01}$. The translated frequency for $F_2$ is 650 Hertz, $F_{02}$, and the translated frequency for $F_3$ is 2050 Hertz, $F_{03}$. The encoded sequence previously described may be decoded by operation of the circuitry shown in FIG. 3 except that the FFX frequency is changed to 6800, illustrated in the column identified as FFX (DEC).

TABLE 1

| $F_1$ | $F_2$ | $F_3$ | FFX | $F_{01}$ | $F_{02}$ | $F_{03}$ | FFX (DEC) |
|---|---|---|---|---|---|---|---|
| 350 | 1050 | 2450 | 5300 | 2250 | 650 | 2050 | 6800 |
| 350 | 1050 | 2450 | 5400 | 2150 | 550 | 1950 | 6700 |
| 350 | 1050 | 2450 | 5500 | 2050 | 450 | 1850 | 6600 |
| 350 | 1050 | 2450 | 5600 | 1950 | 350 | 1750 | 6500 |
| 350 | 1050 | 2450 | 5700 | 1850 | 2550 | 1650 | 6400 |
| 350 | 1050 | 2450 | 5800 | 1750 | 2450 | 1550 | 6300 |
| 350 | 1050 | 2450 | 5900 | 1650 | 2350 | 1450 | 6200 |
| 350 | 1050 | 2450 | 6000 | 1550 | 2250 | 1350 | 6100 |
| 350 | 1050 | 2450 | 6100 | 1450 | 2150 | 1250 | 6000 |
| 350 | 1050 | 2450 | 6200 | 1350 | 2050 | 1150 | 5900 |
| 350 | 1050 | 2450 | 6300 | 1250 | 1950 | 1050 | 5800 |
| 350 | 1050 | 2450 | 6400 | 1150 | 1850 | 950 | 5700 |
| 350 | 1050 | 2450 | 6500 | 1050 | 1750 | 850 | 5600 |
| 350 | 1050 | 2450 | 6600 | 950 | 1650 | 750 | 5500 |
| 350 | 1050 | 2450 | 6700 | 850 | 1550 | 650 | 5400 |
| 350 | 1050 | 2450 | 6800 | 750 | 1450 | 550 | 5300 |

Figure 4A:
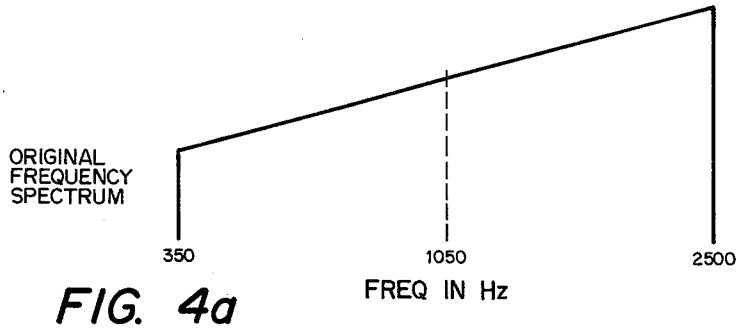
FIGS. 4*a* and 4*b* are frequency spectrums illustrating the operation of the frequency division section of the present voice scrambler system.
Figure 4B:
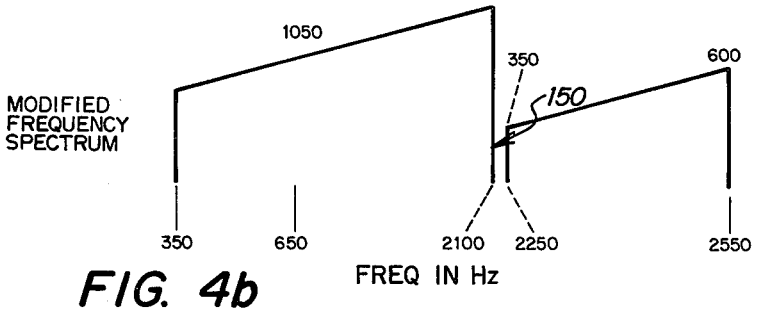

Referring to FIGS. 4*a* and 4*b*, a typical frequency spectrum modification for voice scrambler system 10 frequency division section 56 is illustrated. FIG. 4*a* illustrates the original frequency spectrum which is from 350 Hertz to 2500 Hertz. FIG. 4*b* illustrates the modified frequency spectrum. The frequencies shown at the bottom of the graph of FIG. 4*b* are the frequencies that are transmitted while the frequencies shown at the top of FIG. 4*b* are the original frequencies. The FFX signal used in the previous example illustrating the use of Table 1 was 5300 Hertz. As shown in FIG. 4*b*, a small notch occurs between 2100 Hertz and 2200 Hertz identified by the numeral 150. This notch is due to the finite slopes of the bandpass filters shown in FIG. 3 and has little or no effect on voice quality. As the FFX signal is varied, this notch moves about within the spectrum between 350 Hertz and 2500 Hertz.

Although not specifically described herein, digital frequency control 134 (FIG. 3) is under the control of a random code generator. A suitable random code generator utilized with the present voice scrambler system 10 is described in U.S. Pat. No. 4,115,657 issued to Barrie O. Morgan on Sept. 19, 1978 and entitled "Random Digital Code Generator," the specification of which is herein incorporated by reference. As described more fully therein, the random code generator utilizes a plurality of autonomous sequential circuits which may be interconnected in a plurality of different configurations, each configuration being operable to generate randomized digital signals. The digital signals generated by the sequential circuits are nonlinearly combined and the resulting signal is utilized to control the interconnection of the sequential circuits in order to provide random digital sequences of extremely long cycles.

Figure 5:
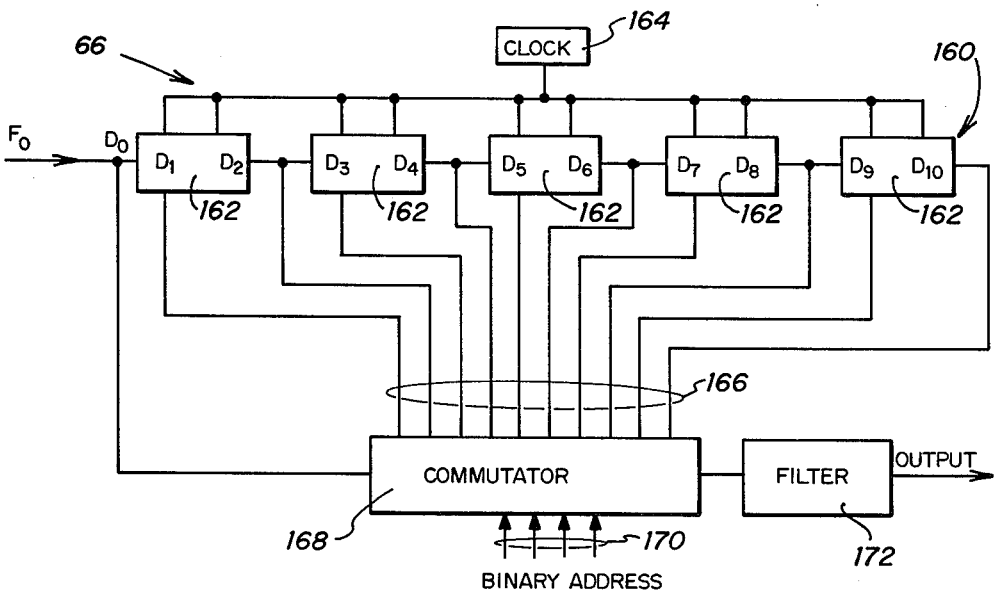
FIG. 5 is a detailed block diagram of the time division segmenting section shown in the block diagram of FIG. 2 of the present voice scrambler system.

Referring to FIG. 5, during transmission of encoded, private, speech, the output of the frequency division section 56 (FIG. 2) is routed to the input of the time division segmenting section 66 (FIG. 2) for further processing of the voice signal. As a result, a second level of voice encoding results using the present voice scrambler system 10. FIG. 5 illustrates in more detail, the time division segmenting section 66 (FIG. 2). The principle of segmenting the voice signal is based on the division of the band limited frequency encoded signal, FRO (FIG. 2), into short segments in time which are then arranged according to a certain predetermined pattern.

In this time division encoding process, the speech signal is divided in time frames, which in the preferred embodiment have a duration of 260 milliseconds. Each time frame is again divided into 8 elements, each of approximately 32 milliseconds duration. The elements in each frame are momentarily stored and arranged in a new order before transmission. The time division segmenting section 66 (FIG. 2) as shown in FIG. 5 comprises a tapped analog delay line generally identified by the numeral 160 consisting of 10 sections. Delay line 160 is implemented by using charged transfer devices (CTD) such as bucket brigade devices 162 or alternatively charge coupled devices. Bucket brigade devices 162 may comprise for example, bucket brigade devices Model No. SAD 1024A, manufactured and sold by Reticon Corporation of Sunnyvale, California. Each bucket brigade device 162 consists of two delay segments identified by the numerals D1–D10. Bucket brigade devices 162 are interconnected in a serial fashion and are clocked by clock 164 in the preferred embodiment at a frequency greater than twice the highest frequency passed by voice scrambling system 10, which in the preferred embodiment is 2500 Hertz.

Each tap on delay line 160 is applied via signal lines 166 to a commutator 168. Commutator 168 is programmed by a binary address along signal lines 170 which are stored in a look-up table stored in a microprocessor associated with voice scrambler system 10. In the preferred embodiment, there are 128, eight-segment permutations stored in the look-up table. These permutations are selected by the key generator associated with voice scrambler system 10.

The output of commutator 168 consists of a continuous stream of voice segments, each segment being 32 milliseconds in duration. Time segmenting is achieved by the random-like time selection of the segments. The clock frequency from clock 164 permits accurate sampling of the input audio signals and occurs at approximately three times the highest frequency rate of the input audio. The output of commutator 168 is applied to a filter 172, which in the preferred embodiment is a 2500 Hertz low pass filter to remove the sampling frequency provided by clock 164. The filtered output signals can be fed to a microphone input of a suitable radio transmitter or into a telephone line for transmission using a suitable interface.

The encoded signal is decoded by routing the signal which has been encoded in both time and frequency to the receiving unit time division segmenting section 66 associated with the receiving voice scrambling system 10. A different portion of the microprocessor look-up table is utilized to reassemble the time segments in the proper order. After these segments have been reassembled in the proper order, they are routed to the frequency division section 56 (FIG. 2) which restores the frequencies to their proper format. Synchronism is maintained between the transmitter and receiver by use of a time reference and regular interval updating of this time reference.

It therefore can be seen that the use of the present voice scrambler system 10 includes a first level of encoding through operation of the frequency division section 56 (FIG. 2) and a second level of encoding utilizing the time division segmenting section 66 (FIG. 2). As a result of this two level or two dimension scrambling of voice signals, a very secure system is provided by the present voice scrambler system 10.

Figure 6:
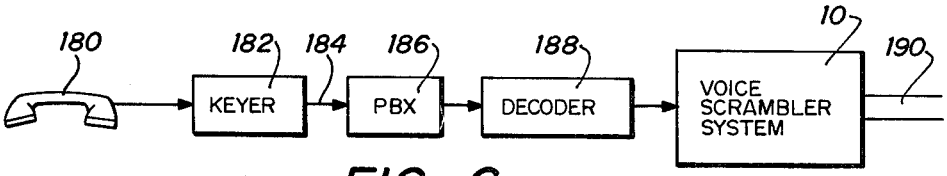
FIG. 6 is a block diagram of the remote voice scrambler system of the present invention.

Referring to FIG. 6, the present voice scrambler system 10 is shown for use in remote application. A telephone hand set 180 including a Push-To-Talk button is interconnected to a keyer 182. The Clear/Private and Push-To-Talk functions are remotely controlled by operation of keyer 182. Keyer 182 is interconnected via a telephone communications link 184 through a private branch exchange 186 to a decoder 188. Decoder 188 provides tone decoding and control functions. Decoder 188 is interconnected to voice scrambler system 10 whose output is applied via a two-pair telephone communications link 190. Keyer 182 may also be directly interconnected to decoder 188 via telephone communications link 184. Through the use of the remote application of voice scrambler system 10, several telephones 180 can be utilized to generate voice messages for encryption by a single voice scrambler system 10. The operation of the voice scrambler system illustrated in FIG. 6 is similar to the operation previously described.

Keyer 182 may also include a Call/Reset function to provide a source of ringing current to be transmitted on telephone communications link 190 to a receiving telephone where no ringing current is present on the telephone communications link.

It will thus be seen that the present invention provides a voice scrambling system which provides dynamic frequency and time levels of encryption. The two-dimension or two-level scrambling system of the present invention provides for a secure voice transmission system which is easy to operate and constructed to be essentially maintenance free.

Whereas the present invention has been described with respect to specific embodiments thereof, it will be understood that various changes and modifications will be suggested to one skilled in the art, and it is intended to encompass such changes and modifications as fall within the scope of the appended claims.

We claim:

1. A voice scrambler system for encryption of a voice signal comprising:

a first generator for generating a fixed frequency signal;

a second generator for generating a plurality of frequency signals;

control means for dynamically controlling said second generator for randomly generating said plurality of frequency signals;

first mixer means for heterodyning the voice signal with said fixed frequency signal generated by said first generator;

first filter means for filtering the output of said first mixer means;

adder means for adding the voice signal and the output of said first filter means;

second mixer means for heterodyning the output of said adder means with one of said plurality of frequency signals generated by said second generator; and second filter means for filtering the output of said second mixer means to generate an encrypted voice signal of a first level of voice encryption.

2. The system of claim 1 and further including:

time division means for splitting said encrypted voice signal into a plurality of discrete time-frequency segments and for randomly selecting ones of said plurality of time-frequency segments to thereby rearrange the order of said plurality of discrete time-frequency segments to provide a second level of voice encryption of the voice signal.

3. The system of claim 2 wherein said time division means comprises a tapped analog delay line.

4. The system of claim 3 wherein said tapped analog delay line includes charge transfer devices.

5. The system of claim 1 and further including:

means for band limiting the voice signal prior to application to said first mixer means.

6. The system of claim 1 and further including:

a third generator for generating a fixed frequency signal;

third mixer means for heterodyning said encrypted voice signal with said fixed frequency signal generated by said third generator; and third filter means for filtering the output of said third mixer means for generating an encrypted voice signal for transmission via a telephone communications link.

7. The system of claim 1 wherein said first filter means filters out the low side-band output from said first mixer means.

8. The system of claim 1 wherein said control means comprises a key generator.

9. The system of claim 1 wherein said first generator generates a signal of about 2300 Hertz.

10. The system of claim 1 wherein said first filter means passes frequencies between approximately 2650 Hertz and approximately 4800 Hertz.

11. The system of claim 1 wherein said second generator generates frequencies between approximately 5300 Hertz and approximately 6800 Hertz.

12. The system of claim 1 wherein said second filter means passes frequencies between approximately 2400 Hertz and approximately 4550 Hertz.

13. The system of claim 5 wherein said means for band limiting comprises:

filter means for passing frequencies between approximately 350 Hertz and approximately 2500 Hertz.

14. The system of claim 6 wherein said third generator generates a signal of approximately 4900 Hertz.

15. The system of claim 6 wherein said third filter means passes frequencies between approximately 350 Hertz and approximately 2500 Hertz.

16. A voice scrambler system for encryption of a voice signal comprising:

a tapped analog delay line including a plurality of charge transfer devices for splitting the voice signal into a plurality of discrete time-frequency segments;

frequency re-entrant means for applying the voice signal to said tapped analog delay line, said frequency re-entrant means including;

a first generator for generating a fixed frequency signal;

a second generator for generating at a predetermined rate a plurality of frequency signals;

control means for dynamically controlling said second generator for randomly generating said plurality of frequency signals;

first mixer means for heterodyning the voice signal with said fixed frequency signal generated by said first generator;

first filter means for filtering the output of said first mixer means;

adder means for adding the voice signal and the output of said first filter means;

second mixer means for heterodyning the output of said adder means with one of said plurality of frequency signals generated by said second generator;

second filter means for filtering the output of said second mixer means; and sampling means for periodically sampling at a predetermined sampling rate the outputs of said plurality of charge transfer devices in a random order for generating an encrypted voice signal.

17. The system of claim 16 wherein said plurality of charge transfer devices comprise bucket brigade devices.

18. The system of claim 16 wherein said sampling means comprises a commutator.

19. The system of claim 16 wherein the sampling rate of said sampling means is greater than said predetermined rate of said second generator.

20. A voice scrambler system for encryption of a voice signal comprising:

a first generator for generating a fixed frequency signal;

a second generator for generating a plurality of frequency signals at a predetermined rate;

a third generator for generating a fixed frequency signal;

control means for dynamically controlling said second generator for randomly generating said plurality of frequency signals;

first filter means for band limiting the voice signal and for generating a filtered voice signal;

first mixer means for heterodyning said filtered voice signal with said fixed frequency signal generated by said first generator;

second filter means for filtering out the low sideband outpt from said first mixer means;

adder means for adding said filtered voice signal and the output of said second filter means;

second mixer means for heterodyning the output of said adder means with one of said plurality of frequency signals generated by said second generator;

third filter means for filtering the output of said second mixer means to generate an encrypted voice signal at a first level of voice encryption;

third mixer means for heterodyning said encrypted voice signal with said fixed frequency generated by said third generator;

fourth filter means for filtering the output of said third mixer means for generating an encrypted voice signal with a predetermined passband for transmission over a communications link;

a tapped analog delay line including a plurality of bucket brigade devices for receiving said encrypted voice signal from said fourth filter means and for splitting said encrypted voice signal into a plurality of discrete time-frequency segments; and means for randomly selecting at a predetermined rate ones of said plurality of time-frequency segments to thereby rearrange the order of said plurality of time-frequency segments and provide a second level of voice encryption for the voice signal.

21. The system of claim 20 and further including:

means for selectively changing said predetermined rate of said second generator.

22. The system of claim 20 wherein said predetermined rate of said second generator is less than said rate for randomly selecting said time-frequency segments.

23. The system of claim 20 wherein said predetermined rate of said second generator is approximately one-half said rate for randomly selecting said time-frequency segments.

24. The system of claim 20 wherein said means for randomly selecting ones of said plurality of time-frequency segments includes a commutator.

25. A method of voice scrambling a voice signal comprising:

generating a first fixed frequency signal;

generating a plurality of variable frequency signals;

dynamically controlling the generation of said plurality of variable frequency signals;

heterodyning the voice signal with said first fixed frequency signal to generate first heterodyned signals;

filtering said first heterodyned signals;

adding the voice signal and said first heterodyned signal to generate a summation signal;

heterodyning said summation signal with one of said plurality of variable frequency signals to generate a second heterodyned signals; and filtering said second heterodyned signals to generate an encrypted voice signal of a first level of voice encryption.

26. The method of claim 25 and further including:

dividing said encrypted voice signal into a plurality of discrete time-frequency segments; and randomly selecting ones of said plurality of time-frequency segments to thereby rearrange the order of said plurality of discrete time-frequency segments to provide a second level of voice encryption of the voice signal.

27. The method of claim 25 and further including:

band limiting the voice signal.

28. The method of claim 25 wherein the step of filtering said first heterodyned signals comprises filtering out the low side-band of said first heterodyned signals.

29. The method of claim 26 wherein said plurality of variable frequency signals are generated at a predetermined rate; and said random selection of ones of said plurality of time-frequency segments occurs at a predetermined rate greater than said rate of generation of said plurality of variable frequency signals.

* * * * *